US008550028B2

(12) United States Patent
Margolies

(10) Patent No.: US 8,550,028 B2
(45) Date of Patent: Oct. 8, 2013

(54) THERMAL SPRAY STREAM FOCUSING

(75) Inventor: Joshua Lee Margolies, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 504 days.

(21) Appl. No.: 12/652,590

(22) Filed: Jan. 5, 2010

(65) Prior Publication Data

US 2011/0162577 A1 Jul. 7, 2011

(51) Int. Cl.
*B05C 5/02* (2006.01)

(52) U.S. Cl.
USPC ..... 118/301; 118/304; 118/504

(58) Field of Classification Search
USPC ..... 118/301, 304, 504; 427/421.1, 422, 427/282; 219/121.47, 121.48, 121.5, 76.16
See application file for complete search history.

(56) References Cited

U.S. PATENT DOCUMENTS

| | | | | |
|---|---|---|---|---|
| 3,318,281 | A * | 5/1967 | Edouard Plegat Alain | 118/672 |
| 2002/0012743 | A1 * | 1/2002 | Sampath et al. | 427/58 |
| 2008/0085371 | A1 | 4/2008 | Gudlavalleti et al. | |
| 2009/0056620 | A1 | 3/2009 | Oda et al. | |

FOREIGN PATENT DOCUMENTS

| | | | |
|---|---|---|---|
| JP | 10273768 | A | 10/1998 |

* cited by examiner

*Primary Examiner* — Laura Edwards
(74) *Attorney, Agent, or Firm* — Ernest G. Cusick; Hoffman Warnick LLC

(57) ABSTRACT

A thermal spray stream focusing approach is provided. In one aspect, at least two pairs of rollers are located about a spray device. The at least two pairs of rollers are configured to shape a raw spray stream generated from the spray device to a shape-defined spray stream that is focused towards a surface of a workpiece.

14 Claims, 2 Drawing Sheets

THERMAL SPRAY STREAM FOCUSING

BACKGROUND OF THE INVENTION

The present invention relates generally to thermal spraying of workpieces and more particularly to focusing the spray plume of a spray stream generated from a thermal spray device onto a workpiece for deposit optimization and coating consistency.

Turbine parts or components are one example of workpieces that typically undergo a thermal spraying process in order to inhibit corrosion or oxidation. Typically, the turbine components are sprayed with a metallic coating to inhibit the corrosion or oxidation that arises due to the temperatures in which they operate. The metallic coating acts as a sacrificial layer that oxidizes before the turbine component and, thus slows the oxidation process. In addition to the metallic coating, turbine components may be coated with a ceramic layer that functions to slow the heating of the component.

In a typical thermal spraying process of a turbine component, a metallic powder is heated up to a softened point where its particles can be sprayed onto the component by a spray device to make a coating that has a thickness that can range from about 5 mils—thousandths of an inch—to about 20 mils; although the thickness will vary depending upon the ultimate application of the component. The spray stream generated from the spray device is generally divergent which makes it difficult to coat the complicated geometries associated with many turbine components such as an airfoil (e.g., fillet radiuses) with uniform, high coating quality. In particular, the divergent spray stream is characterized by a spray plume (i.e., the hot molten center) and a cooler overspray (i.e., the periphery of the stream) with particles that perhaps may not be molten at all. It is the particles from the cooler periphery that collect and build up in the coating of areas having complex geometries and ultimately reduce the quality of the coating of the component. For example, a platform in a turbine bucket where an airfoil transitions from a dovetail will have build up of particles from the periphery. Because the particles associated with the periphery are inferior in comparison to the particles with the spray plume, the quality of the coating at the platform will be reduced, which ultimately affects the life and performance of the component because this area will be susceptible to corrosion and oxidation.

One approach that has been utilized to address the issues associated with a divergent spray stream is to use a masking process in conjunction with the thermal spraying process. Using a masking process in a thermal spraying process of a turbine component generally involves placing a hard metal mask over a particular part of the turbine component to protect it from being coated with the spray stream. In the case of a turbine bucket, there are a multitude of cooling holes (e.g., hundreds) that have to be laboriously filled with the masking material before applying the coating and then laboriously removed after the thermal spraying process has concluded. Even so, a thermal spraying process that utilizes a mask is unable to control focusing of the spray stream in and around the cooling holes and other fine areas such that only the spray plume is used to provide coating and not both the spray plume and periphery.

BRIEF DESCRIPTION OF THE INVENTION

Therefore, it is desirable to be able to perform a thermal spraying process of a workpiece without having to use a mask. Furthermore, it is desirable to have the capability to control the focusing of the spray stream (i.e., the spray plume and spray periphery) generated from the spray device in order to make the thermal spray process better suited for coating workpieces having complex geometries. Controlled focusing of the spray stream would permit for a more consistent coating applied to the workpiece, which would result in the workpiece performing better and having an extended life.

In one aspect of the present invention, a system is provided. The system comprises a spray device and at least two pairs of rollers located orthogonal to one another, between the spray device and a surface to be coated by the spray device. Each of the at least two pairs of rollers are located in a raw spray stream generated from the spray device. Each of the at least two pairs of rollers are configured to shape the raw spray stream generated from the spray device to a shape-defined spray stream that coats the surface.

In another aspect of the present invention, a system for thermal spraying a workpiece is provided. In this aspect of the present invention, there is a spray device configured to generate a raw spray stream towards the workpiece. The raw spray stream has a spray stream center and a spray stream periphery. At least two pairs of rollers are located about the spray device. Each of the at least two pairs of rollers are located in a path of the raw spray stream generated from the spray device. Each of the at least two pairs of rollers are configured to shape the raw spray stream generated from the spray devices to a shape-defined spray stream by permitting the spray stream center to pass therethrough, while preventing the spray steam periphery from passing therethrough.

In a third aspect of the present invention, a system for thermal spraying a turbine component is disclosed. In this aspect of the present invention, there is a spray device configured to generate a raw spray stream towards the turbine component. The raw spray stream has a spray stream center and a spray stream periphery. At least two pairs of rollers are located about the spray device. Each of the at least two pairs of rollers are configured to shape the raw spray stream generated from the spray device to a shape-defined spray stream by permitting the spray stream center to pass therethrough, while preventing the spray steam periphery from passing therethrough. The at least two pairs of rollers comprise a first pair of rollers and a second pair of rollers. The first pair of rollers are configured to shape the raw spray stream generated from the spray device into a spray stream line and the second pair of rollers are configured to reduce the spray stream line to a substantially square-shaped spray stream that is focused to the turbine component.

DETAILED DESCRIPTION OF THE INVENTION

Figure 1:
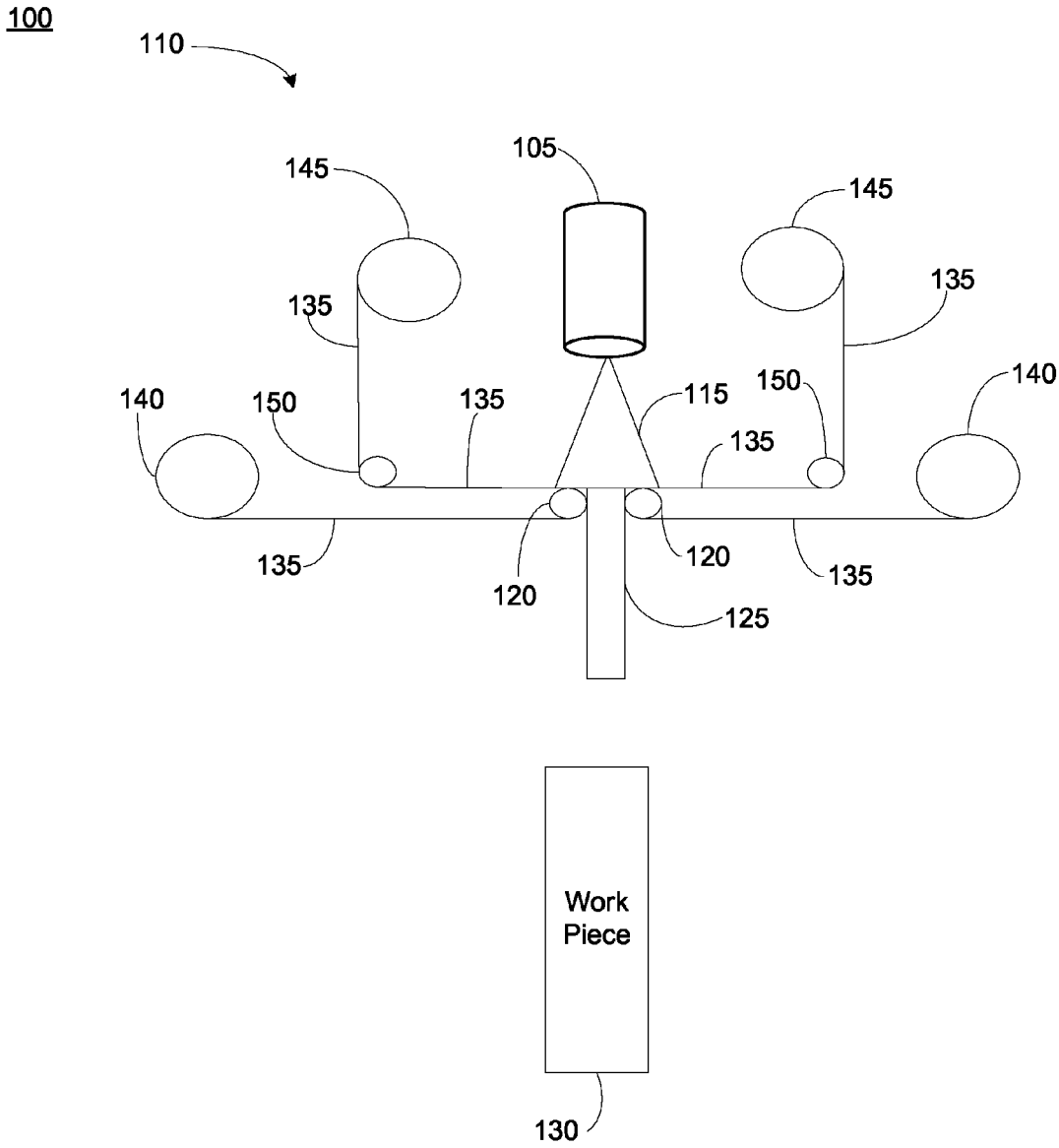
FIG. 1 is a schematic diagram of a portion of a thermal spraying system according to one embodiment of the present invention.

Various embodiments of the present invention are directed to a thermal spraying system that is configured to select the particle plume center of a raw spray stream generated from a spray device and focus it towards a workpiece, while removing the particle periphery of the spray stream. Selecting the particle plume center, as opposed to the particle periphery, is where the thermal history and velocity of the particles of the spray stream are the most homogeneous. Reducing the footprint of the spray stream such that only the particle plume center is focused towards the workpiece, results in a particle deposition that is consistent in its coating and higher quality. Unmelted and over injected particles that are typically associated with the particle periphery are eliminated and not focused on the workpiece. The controlled focusing of the spray stream that is associated with the various embodiments of the thermal spraying system described herein enables quality coatings of workpieces having complex geometries.

The various embodiments of the thermal spraying system described herein are used in a thermal spray process of a workpiece such as a turbine component (e.g., a turbine blades and vanes, turbine shrouds, buckets, nozzles, combustion liners and deflectors and the like). Although the following description is in reference to using the various embodiments of the thermal spraying system to thermal spray a turbine component, the embodiments of the present invention are not limited to use solely with turbine components. Those skilled in the art will recognize that the various embodiments of the thermal spraying system can be used to thermally spray any workpiece that has a need to be coated with a metallic coating, ceramic coating or combinations thereof. Furthermore, the type of workpiece that is suitable for use with the various embodiments of the thermal spraying system is not limited to any particular geometry. In particular, the various embodiments of the thermal spraying system can be used in the thermal spraying of workpieces having simple and complex geometries. A non-exhaustive list of examples of possible workpieces that may undergo a thermal spraying process with the various embodiments of the present invention includes re-dimensioning of worn shafts, replacing lost material from corroded marine structures, localized build-up of material on an existing element to provide a new feature, diamond pattern tread for anti-skid applications, coating the tips or roots of gears with wear resistant material.

As mentioned above, a conventional thermal spraying process of a turbine component typically involves using a mask to protect various parts of the component (e.g., cooling holes along an airfoil) from being coated with the spray stream. The use of the mask is helpful in protecting certain parts of the turbine from being coated with the spray stream, but the masking process is not helpful in addressing the problems that the divergent spray stream presents to the coating of various turbine components, especially those components that have complex geometries (e.g., fillet radiuses). As mentioned above, the divergent spray stream is characterized by a hot molten center spray plume and a cooler periphery with particles that perhaps may not be molten at all. Because these conventional thermal spraying processes are unable to control the focusing of the spray stream, particles from the cooler periphery collect and build up in areas where geometries of the turbine component are complex. Having particles that may not be molten accumulating on the turbine component results in poor quality coating of the component, which corresponds to having a component that will have a reduced life and not perform very well.

Referring to the drawings, FIG. 1 is a schematic diagram of a thermal spraying assembly 100 that is used with a thermal spraying system according to one embodiment of the present invention. The thermal spraying assembly 100 includes a thermal spraying device 105 with a roller assembly 110. The spray device 105 is configured to generate a raw spray stream 115 characterized by a center plume and periphery. Embodiments of the present invention are not limited to any particular type of spray device. Some non-limiting examples of thermal spray devices include direct current (DC) plasma spray, wire-arc spray, flame spray or high-velocity oxygen fuel thermal spray process (HVOF).

The raw spray stream 115 generated from the spray device 105 includes partially or fully melted material particles that are accelerated to high velocities. Embodiments of the present invention are not limited to any particular type of material to form the raw spray stream. Those skilled in the art will recognize that embodiments of the present invention are suitable for use with any thermal barrier coatings that may typically be used to coat workpieces. Generally, the material used to generate the raw spray stream 115 may include metal materials, polymeric materials, ceramic materials and/or combinations thereof.

As shown in FIG. 1, the roller assembly 110 in this portion of the thermal spraying assembly 100 includes a pair of rollers 120 that are placed in the path of the raw spray stream 115 generated by the spray device 105. The pair of rollers 120 are placed a predetermined distance apart from each other to form a slit therebetween allowing the plume or center of the raw spray stream 115 to pass therethrough. As a result, the pair of rollers 120 are configured to shape the raw spray stream 115 to a shape-defined spray stream 125 that is subsequently applied to a surface of a workpiece 130. Generally, the predetermined distance separating the rollers 120 will depend on the application. For example, if a lower quality coating were used, then it may be desirable to have a distance that provides a relatively broad opening between the rollers 120 (e.g., from about 6 mm to about 8 mm). If one were interested in thermal spraying about the cooling holes of an airfoil, then the distance between the rollers 120 might be smaller in order to obtain the necessary spacing to spray between the cooling holes.

In one embodiment, each roller 120 receives thermal spray foil 135 from a supply spool 140 containing the foil. The thermal spray foil 135 does not pass through the path of the raw spray stream 115 and instead wraps around the roller to protect it from melting due to the heat of the raw spray stream 115 and maintain a clean, precisely located surface throughout the spray process. The thermal spray foil 135 may be a stainless steel material or a carbon steel material, although any material that can withstand the heat of the raw spray stream 115 and that can be wound around the rollers 120 may be suitable for use. In addition, as a further protective measure, each roller 120 may be chilled to a predetermined temperature in order to account for the extremely hot temperatures (e.g., 1000° F. to 10,000° F.) that typically occur in a thermal spray process. As an example, each roller 120 may be chilled to a temperature that ranges from about 40° F. to about 400° F.

In order to prevent a coating of particles from the periphery of the raw spray stream 115 from building up, the thermal spray foil 135 that passes through each roller 120 is passed along to a respective take-up spool 145 via a respective guide pulley 150. In particular, the thermal spray foil 135 is unwound off each supply spool 140 and then wrapped upward around roller 120. The thermal spray foil 135 then proceeds underneath guide pulley 150 and wound onto the take-up spool 145. Those skilled in the art will recognize that prior to operating this portion of the thermal spraying system, an initial portion of the thermal spray foil 135 may be taken from each supply spool 140 and moved along a respective roller 120, up to a respective guide pulley 150 and wound onto the take-up spool 145 before generating the raw thermal spray stream in order to facilitate a smooth transition of the foil from the supply spool 140 to the take-up spool 145.

Although not illustrated in FIG. 1, the rollers 120, supply spools 140, take-up spools 145 and guide pulleys 150 could be mounted on a stage or housing that can accommodate such a configuration described herein. In addition, although not shown, a motor using belt drives could be used to drive rollers 120, supply spools 140, take-up spools 145 and guide pulleys 150 to move the spray stream foil 135 during the thermal spray process. Control of the rollers 120, supply spools 140, take-up spools 145 and guide pulleys 150 during the thermal spray process may be performed by a controller or in another embodiment less sophisticated control such as a potentiometer could be used to drive the motor and belt drives that drive the rollers, spools and pulleys.

The speed of operating the rollers 120, supply spools 140, take-up spools 145 and guide pulleys 150 will depend on the heat load that the rollers will experience. For example, if a low power (e.g., 25 kW) plasma spray device were used, then the speed would not need to be that great. In another example, if one desired to coat the workpiece 130 with a high material feedrate, then a high power spray device (e.g., 250 kW) would be used, which would necessitate that the speed of the rollers 120, supply spools 140, take-up spools 145 and guide pulleys 150 be increased to prevent the raw spray stream 115 from burning through the thermal spray foil 135 and damaging the rollers.

Figure 2:
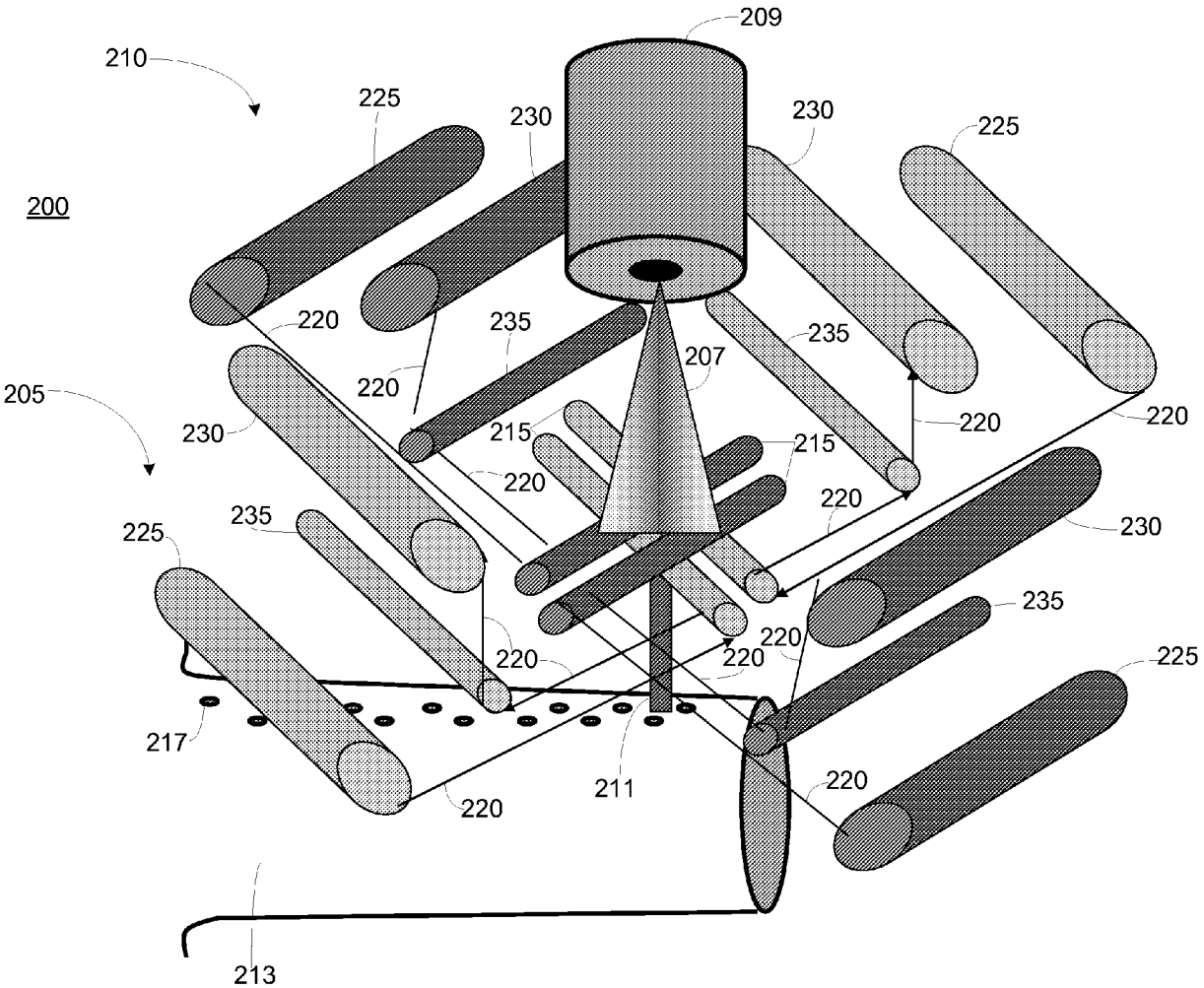
FIG. 2 is a schematic diagram of a complete thermal spraying system that incorporates elements depicted in FIG. 1 according to one embodiment of the present invention.

FIG. 2 is a schematic diagram of a complete thermal spraying system 200 according to one embodiment of the present invention. In this embodiment, the thermal spraying system 200 comprises two roller assemblies as depicted in FIG. 1 that are orthogonal to one another, between the spray device and configured to generate a shape-defined spray stream that produces a square footprint. With this configuration, the raw spray stream is first reduced to a spray stream line of desired width by one of the roller assemblies and then the spray stream line is reduced to a substantially square-shaped spray plume by the other roller assembly.

Although the description that follows for FIG. 2 is with respect to a thermal spraying system that includes a first roller assembly and a second roller assembly, those skilled in the art will appreciate that additional thermal spraying device assemblies can be added to the configuration shown in FIG. 2 to produce a shape-defined spray stream that is different from the substantially square footprint. For example, an additional roller assembly would result in a hexagonal footprint and a fourth roller assembly would result in an octagon footprint. For ease of illustrating embodiments of the present invention, only the embodiment having the first roller assembly and the second roller assembly are explained, and those skilled in the art will readily recognize how to implement the additional roller assemblies in order to obtain the desired shape-defined spray stream.

Referring back to FIG. 2, the thermal spraying system 200 comprises two roller assemblies 205 and 210 that are mirror images of each other and that are stacked orthogonally with respect to each other. As described in FIG. 1, each roller assembly 205 and 210 includes a pair of rollers 215 that are placed in the path of a raw spray stream 207 generated by a spray device 209. Each roller 215 receives a thermal spray foil 220 from a supply spool 225 containing the foil. As mentioned above, the thermal spray foil 220 does not pass through the path of the raw spray stream 207 generated from the spray device 209 and instead wraps around the roller to protect it from melting due to the heat of the raw spray stream and maintain a clean, precisely located surface throughout the spray process. The thermal spray foil 220 that passes through each roller 215 is passed along to a respective take-up spool 230 via a respective guide pulley 235. In particular, the thermal spray foil 220 is unwound off each supply spool 225 and then wrapped upward around roller 215. The thermal spray foil 220 then proceeds underneath guide pulley 235 and wound onto the take-up spool 230.

In operation of the thermal spraying system 200, the raw spray stream 207 generated from the spray device 209 flows through the center of the first roller assembly 210. The thermal spray plume hits the first roller assembly 210 and the irregular-shaped cone of hot particles is reduced to a spray stream line of desired width and overspray or periphery of the plume strikes the thermal spray foil 220 and is carried away to the take-up spools 230. The spray stream line that passes through the rollers 215 of the first roller assembly 210 hits the second roller assembly 205. Because the second roller assembly 205 is rotated 90 degrees relative to the first roller assembly 210, the spray stream line is reduced to a well-defined substantially square-shaped spray plume by the rollers 215 of the second roller assembly 205. The substantially square-shaped spray plume or footprint 211 is then focused towards a surface of a workpiece 213. In the embodiment shown in FIG. 1, the workpiece 213 is a stylized airfoil with cooling holes 217 located about its surface. In this embodiment, the substantially square-shaped spray plume 211 deposits coating between the cooling holes 217.

In this embodiment, the pair of rollers 215 from the first roller assembly 210 creates a first slit and the pair of rollers 215 from the second roller assembly 205 form a second slit that results in a cross-slit configuration. As a result, the spray stream generated from the first roller assembly 210 shapes a spray stream line while the spray stream generated from the second roller assembly 205 reduces that spray stream line to a substantially square-shaped spray stream 211 that is focused on the workpiece 213. Those skilled in the art will recognize that the second roller assembly 205 does not need to be as big as the first roller assembly 210, because the first roller assembly absorbs the majority of the excess heat and particles.

While the rollers from the first roller assembly 210 and the second roller assembly 205 act to define a spray stream footprint from the center part of the raw spray stream 207 generated by the thermal spray device 209, the thermal spray foil 220 carries the periphery (plume or overspray) of the spray stream to the take-up spools 230 where the particles can be reclaimed from the foil allowing it to be recycled. Once all of the thermal spray foil 220 has been used, then another supply spool of material can be used for the next thermal spray process. In another embodiment, it may be possible to reuse the thermal spray foil 220 after reclaiming the material from the take-up spool 230 by respooling the supply spool 225 or by simply rewinding the foil from the take-up spool back through the guide pulley 235 to the supply spool.

The configuration described in FIG. 2 enables embodiments of the present invention to remove the periphery of the raw spray stream 207 from being used in the thermal spray process of the workpiece 213, such that only the center part of the stream is used to coat the workpiece. Because only the molten part of the center of the raw spray stream 207 is used in the thermal spray process and not the non-molten periphery, the workpiece 213 will have a higher quality coating because at the center the particles are at about the same temperature and moving at about the same velocity. Providing control of the raw spray stream 207 in the thermal spray process and generating a desired spray definition allows one to apply coatings to more detail areas of the workpiece (e.g., bucket tip coatings, coating between/around cooling holes) which are too hard to coat with conventional thermal spray coating processes because the resulting footprint is too large. In addition, embodiments of the present invention obviate the need to use a mask with a thermal spray process.

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A system, comprising:

a spray device;

at least two pairs of rollers located about the spray device, each of the at least two pairs of rollers located orthogonal to one another, between the spray device and a surface to be coated by the spray device, each of the at least two pairs of rollers are located in a raw spray stream generated from the spray device, each of the at least two pairs of rollers are configured to shape the raw spray stream generated from the spray device to a shape-defined spray stream that coats the surface;

at least two pairs of thermal spray foil supply spools, each pair of thermal spray foil supply spools configured to supply thermal spray foil to one pair of the at least two pairs of rollers, wherein the thermal spray foil supplied from each pair of thermal spray foil supply spools to the one pair of the at least two pairs of rollers wraps around rollers in the one pair of the at least two pairs of rollers without passing directly through a path of a portion of the raw spray stream that is shaped by the one pair of the at least two pairs of rollers to form the shape-defined spray stream that coats the surface;

at least two pairs of take-up spools, each pair of take-up spools configured to receive the thermal spray foil after passing through one of the at least two pairs of rollers; and at least two pairs of guide pulleys, each pair of guide pulleys configured to guide the thermal spray foil from one of the at least two pairs of rollers to one of the pairs of take-up spools operating therewith.

2. The system according to claim 1, wherein the rollers of each of the at least two pairs of rollers are chilled to a predetermined temperature.

3. The system according to claim 1, wherein the at least two pairs of rollers comprises a first pair of rollers and a second pair of rollers, the first pair of rollers configured to shape the raw spray stream generated from the spray device into a spray stream line and the second pair of rollers configured to reduce the spray stream line into a substantially square-shaped spray stream.

4. The system according to claim 3, wherein the first pair of rollers creates a first slit in the raw spray stream generated from the spray device and the second pair of rollers creates a second slit in the raw spray stream generated from the spray device, the first slit and second slit forming a cross-slit configuration.

5. The system according to claim 1, wherein the thermal spray foil protects the rollers from melting due to heat of the raw spray stream and maintains the rollers with a clean, precisely located surface.

6. The system according to claim 1, further comprising a motor that drives the at least two pairs of rollers, the at least two pairs of thermal spray foil supply spools, the at least two pairs of take-up spools and the at least two pairs of guide pulleys, wherein the at least two pairs of rollers and the at least two pairs of thermal spray foil supply spools each operates at a speed that is a function of a heat load placed on the at least two pairs of rollers by the raw spray stream generated from the thermal spray device.

7. A system for thermal spraying a workpiece, comprising:

a thermal spray device configured to generate a raw spray stream towards the workpiece, the raw spray stream having a spray stream center and a spray stream periphery;

at least two pairs of rollers located about the thermal spray device, each of the at least two pairs of rollers located in a path of the raw spray stream generated from the thermal spray device, each of the at least two pairs of rollers configured to shape the raw spray stream generated from the thermal spray device to a shape-defined spray stream by permitting the spray stream center to pass therethrough, while preventing the spray steam periphery from passing therethrough;

at least two pairs of thermal spray foil supply spools, each pair of thermal spray foil supply spools configured to supply thermal spray foil to one pair of the at least two pairs of rollers, wherein the thermal spray foil supplied from each pair of thermal spray foil supply spools to the one pair of the at least two pairs of rollers wraps around rollers in the one pair of the at least two pairs of rollers without passing directly through a path of a portion of the spray stream center that is shaped by the one pair of the at least two pairs of rollers to form the shape-defined spray stream that is directed towards the workpiece;

at least two pairs of take-up spools, each pair of take-up spools configured to receive the thermal spray foil after passing through one of the at least two pairs of rollers; and at least two pairs of guide pulleys, each pair of guide pulleys configured to guide the thermal spray foil from one of the at least two pairs of rollers to one of the pairs of take-up spools operating therewith.

8. The system according to claim 7, wherein the rollers of each of the at least two pairs of rollers are chilled to a predetermined temperature.

9. The system according to claim 7, wherein the at least two pairs of rollers comprises a first pair of rollers and a second pair of rollers, the first pair of rollers configured to shape the raw spray stream generated from the thermal spray device into a spray stream line and the second pair of rollers configured to reduce the spray stream line to a substantially square-shaped spray stream.

10. The system according to claim 9, wherein the first pair of rollers creates a first slit in the raw spray stream generated from the thermal spray device and the second pair of rollers creates a second slit in the raw spray stream generated from the thermal spray device, the first slit and second slit forming a cross-slit configuration.

11. The system according to claim 7, wherein the thermal spray foil protects the rollers from melting due to heat of the raw spray stream and maintains the rollers with a clean, precisely located surface.

12. A system for thermal spraying a turbine component, comprising:

a thermal spray device configured to generate a raw spray stream towards the turbine component, the raw spray stream having a spray stream center and a spray stream periphery;

at least two pairs of rollers located about the thermal spray device, each of the at least two pairs of rollers configured to shape the raw spray stream generated from the thermal spray device to a shape-defined spray stream by permitting the spray stream center to pass therethrough, while preventing the spray steam periphery from passing therethrough, wherein the at least two pairs of rollers comprises a first pair of rollers and a second pair of rollers, the first pair of rollers configured to shape the raw spray stream generated from the thermal spray device into a spray stream line and the second pair of rollers configured to reduce the spray stream line to a substantially square-shaped spray stream that is focused to the turbine component;

at least two pairs of thermal spray foil supply spools, each pair of thermal spray foil supply spools configured to supply thermal spray foil to one pair of the at least two pairs of rollers, wherein the thermal spray foil supplied from each pair of thermal spray foil supply spools to the one pair of the at least two pairs of rollers wraps around rollers in the one pair of the at least two pairs of rollers without passing directly through a path of a portion of the spray stream center that is shaped by the one pair of the at least two pairs of rollers to form the shape-defined spray stream that is directed towards the turbine component;

at least two pairs of take-up spools, each pair of take-up spools configured to receive the thermal spray foil after passing through one of the at least two pairs of rollers; and at least two pairs of guide pulleys, each pair of guide pulleys configured to guide the thermal spray foil from one of the at least two pairs of rollers to one of the pairs of take-up spools operating therewith.

13. The system according to claim 12, wherein the rollers of each of the at least two pairs of rollers are chilled to a predetermined temperature.

14. The system according to claim 12, wherein the thermal spray foil protects the rollers from melting due to heat of the raw spray stream and maintains the rollers with a clean, precisely located surface.

* * * * *